US006499501B1

(12) United States Patent
Hoeptner, III

(10) Patent No.: US 6,499,501 B1
(45) Date of Patent: Dec. 31, 2002

(54) CONDUIT SYSTEM FOR PROXIMATE FLOW OF CLEAN AND WASTE WATER

(76) Inventor: Herbert W. Hoeptner, III, 7796 Oak Springs Cir., Gilroy, CA (US) 95020

( * ) Notice: Subject to any disclaimer, the term of this patent is extended or adjusted under 35 U.S.C. 154(b) by 0 days.

(21) Appl. No.: 09/977,731

(22) Filed: Oct. 15, 2001

(51) Int. Cl.[7] ..... E03C 1/12
(52) U.S. Cl. ..... 137/216; 137/801
(58) Field of Search ..... 137/216, 801

(56) References Cited

U.S. PATENT DOCUMENTS 4,134,419 A * 1/1979 Richetti ..... 137/216
4,856,121 A * 8/1989 Traylor ..... 137/216
5,875,809 A 3/1999 Barrom

* cited by examiner

*Primary Examiner*—Gerald A. Michalsky
(74) *Attorney, Agent, or Firm*—William W. Haefliger

(57) ABSTRACT

In a system for handling closely proximate flows of relatively clean and unclean water, the combination comprising a first conduit for passing relatively clean water to a first discharge, a second conduit extending protectively about the first conduit, a third conduit extending proximate and lengthwise of the second conduit for passing said relatively unclean water, outside the second conduit, and an outer housing extending about said first, second and third conduits.

8 Claims, 3 Drawing Sheets

14
150
14a
17
16a
16
15a
30
15
81
80
29
28
13

24
49
10
2
2
53
50
51
12
52
54
11
35b
48
21b
24
21c
1
1
13
21a
21e
21
23
-35-
21d
22
35c
27
23
37
38
26

CONDUIT SYSTEM FOR PROXIMATE FLOW OF CLEAN AND WASTE WATER

BACKGROUND OF THE INVENTION

This invention relates generally to systems for proximity flows of clean water and unclean waste water in proximity, as in kitchens; and more particularly concerns a simple, efficient, conduit system for such proximal flows, and occupying minimum space.

In many kitchens, installed sinks have multiple holes in a top panel, with two separate holes for hot and cold water conduits, and a third hole for a separate water supply conduit. A fourth hole is often employed in the plate, for a waste water conduit, that often employs a vent conduit that prevents waste water siphoning back into a dishwasher. There is need to reduce the number of such holes in such a panel, and to reduce the size of the overall space occupied by such a conduit system at the panel.

SUMMARY OF THE INVENTION

It is a major object of the invention to provide an improved conduit assembly, meeting the above need. Basically, the improved system includes:

a) a first conduit for passing relatively clean water to a first discharge, b) a second conduit extending protectively about the first conduit, c) a third conduit extending proximate and lengthwise of the second conduit for passing relatively unclean water, outside the second conduit, d) and an outer housing extending about said first, second and third conduits, to be installed in a single hole in the panel.

As will be seen, the source of unclean water may comprise an automatic dishwasher having a discharge positioned for passing relatively unclean dish water, to flow in that third conduit.

Another object is to provide the third conduit to have a free discharge proximate to, but isolated from the interior of said second conduit. A conduit may be provided in integral association with the third conduit; and having an entrance to receive contaminated water discharged from the third conduit. A panel such as a counter or sink top panel may provide an opening through which said first, second, third and fourth conduits pass.

Yet another object is to provide a compact assembly in which at least two of the second, third and fourth conduits have a common wall. Typically three common walls may be provided, wherein i) the second and third conduits have a primary common wall, ii) the second and fourth conduits have a secondary common wall, and iii) the third and fourth conduits have a tertiary common wall.

The common walls may, as well be seen, have a common junction, from which the common walls extend, arcuately, to closely and compactly fit within a surrounding annular mounting structure, clamped in position on a counter top.

Yet another object is to provide for drinking water flow upwardly in the first conduit, spaced from the second conduit wall, so that unclean water flows downwardly between the second and third conduit walls, isolated from the first conduit.

These and other objects and advantages of the invention, as well as the details of an illustrative embodiment, will be more fully understood from the following specification and drawings, in which:

DRAWING DESCRIPTION

DETAILED DESCRIPTION

Figure 4:
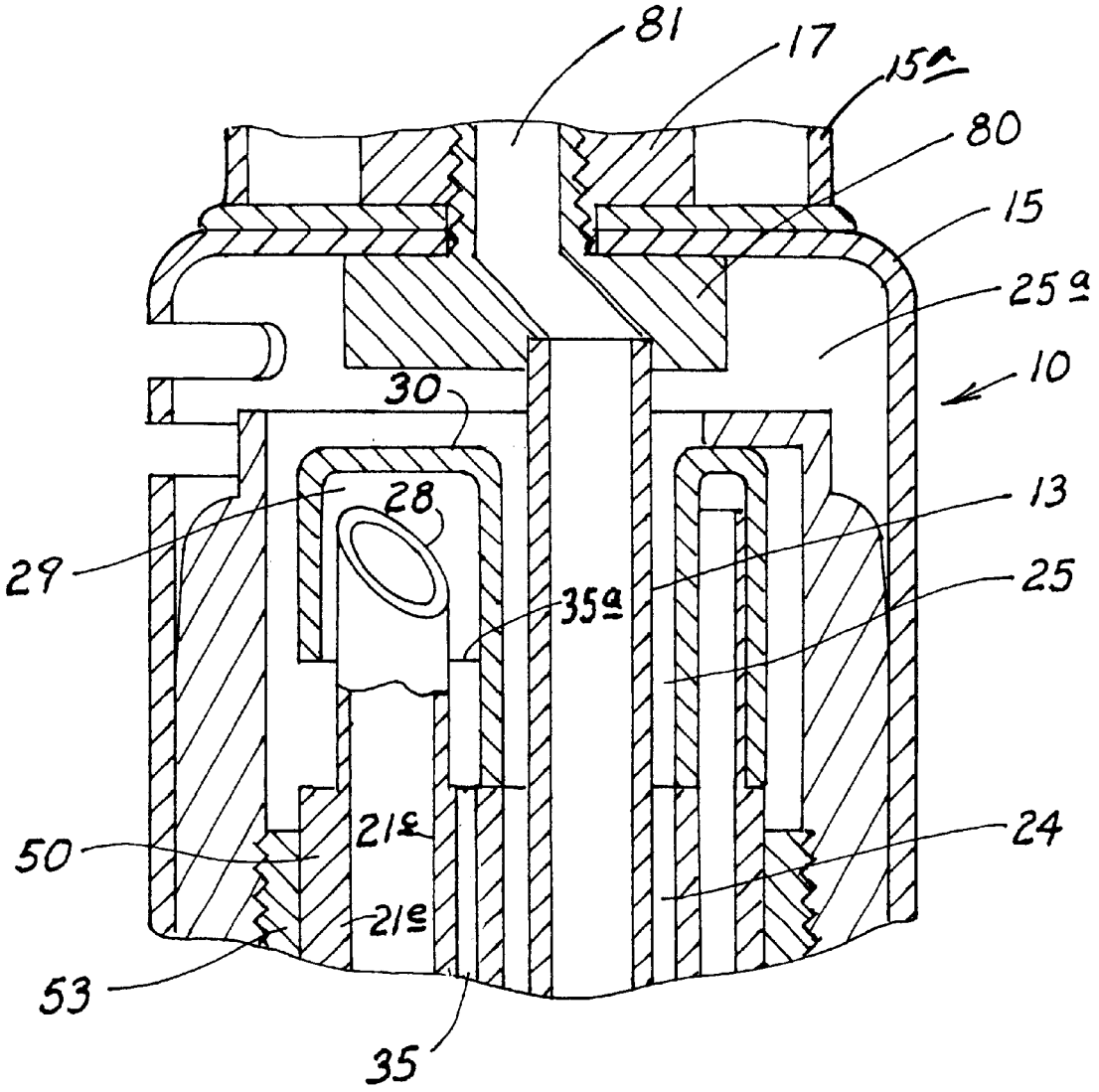
FIG. 4 is an enlarged fragmentary section taken through the upper portion of FIG. 1.

In the drawings, a system 10 is provided for handling closely proximate flows of relatively clean and unclean water, whereby only one opening 11 in a counter top 12, or other panel, is required to pass the flows. For example, clean drinking water flows upwardly in a first conduit, in the form of a duct 13, that discharges into a tubular spout 14. Drinking water flow from the spout is indicated at 150. A valve 16 is provided within a tubular fitting 17 interposed in series between duct 13 and the inlet 14*a* to spout 14 to control flow to the spout, as by movement of valve handle 16*a*. A tubular housing 15 and cap 15*a* are provided above the counter top 12, to surround the upper end of the duct 13, the fitting 17, valve 16 and inlet 14*a*, as shown. The top of duct 13 fits in a nut 80 defining a passage 81 that leads to valve 16. See FIG. 4.

A second conduit extends protectively around duct 13, and may take the form of web-like wall segments 21*a*, 21*b* and 21*c* of second conduit structure 21 that provides interior hollow or space 24 extending lengthwise parallel to the conduit 13 and about conduit 13. Structure 21 is compactly located within cylindrical wall 22 that may be integral with the curved segments 21*a*, 21*b* and 21*c*. The second conduit is formed by segments 21*a*, 21*b*, and 21*c*, seen in FIG. 2. Space 24 extends closely about duct 13, and is separated from a space 23 by curved segment 21*c*.

The lower end of space 24 may discharge to the exterior, or may be sealingly connected to duct 13, and the upper end of space 24 opens to the enlarged interiors 25 and 25*a* defined by tubular housing 15, and its top cap 15*a*. See FIG. 4. Space 24 defines an escape zone for contaminated water that may leak from a third conduit, describe below. See also air passages 15*a* through skirt 15*b* of cap 15.

The third conduit 23 as shown, is formed by web or wall segments 21*c*, 21*d* and 21*e*. It also extends lengthwise parallel to the first and second conduits, as referred to. Its interior 23 typically receives unclean water as from a dish washer indicated at 26, to flow upwardly at 27 through counter top opening 11, and to an open discharge at 28 in an upper interior (siphon-breaking) space 29 isolated from enlarged interior 25*a*, as by provision of a horizontal wall 30 between 25*a* and 29.

Also provided is a fourth conduit, proximate to said second and third conduits, and having an entrance to receive contaminated water discharged from the third conduit. See for example the fourth conduit 35, having an upper entrance 35*a* to receive unclean water draining from upper interior space 29, and extending downwardly at 35*b* to conduct such water at 35*c* to a discharge, for example to a rotary garbage disposal unit 37 in a sink structure 38. The fourth conduit 35 is located sidewardly closely adjacent to the second and third conduits 24 and 23, for example as is seen in FIG. 2, so that all four conduits pass through the panel opening 11, providing a highly compact, multi-functional assembly, for drinking water access and for disposal of waste or unclean water.

Figures 1, 2, 3:
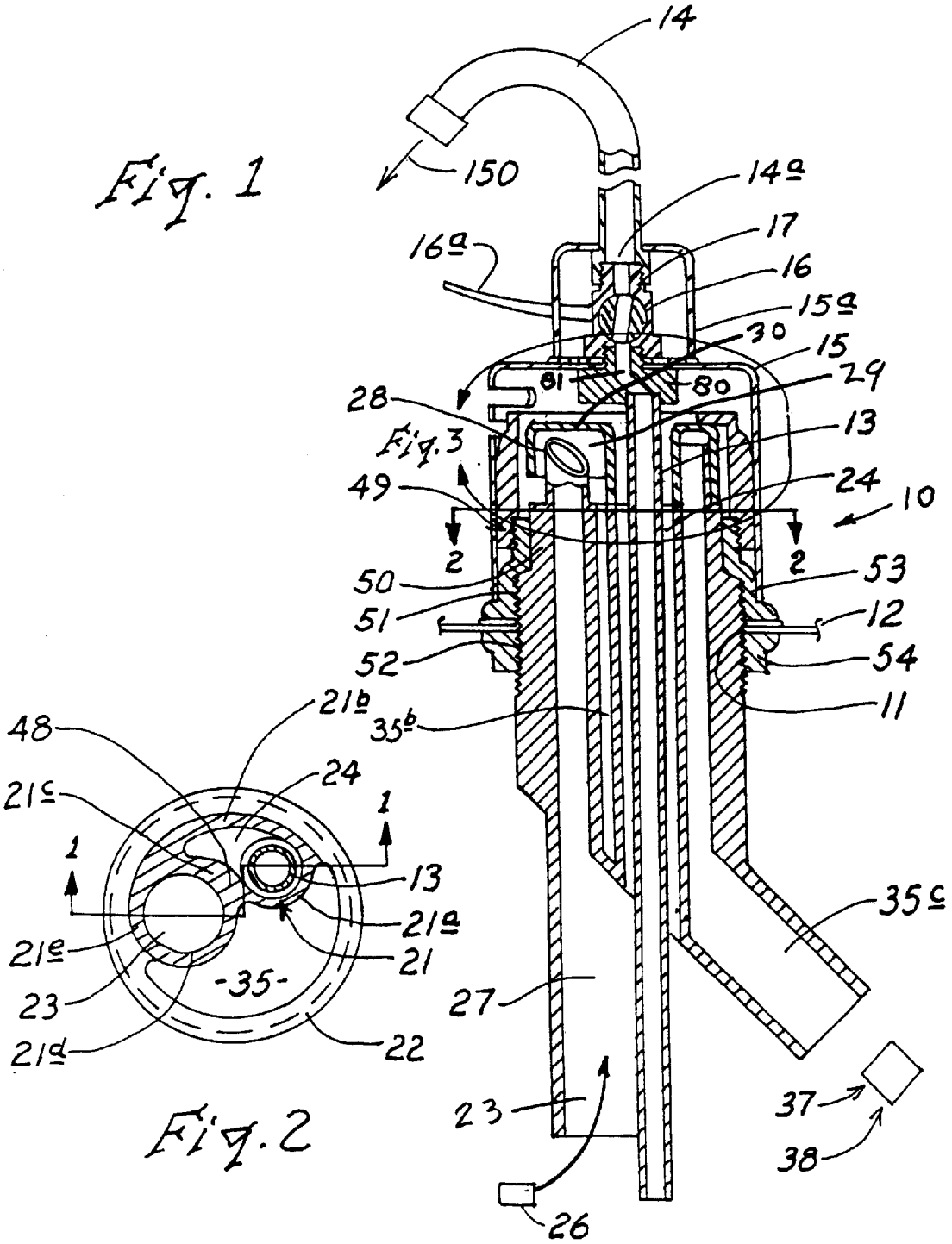
FIG. 1 is a vertical section taken through a conduit system for handling closely proximate flows of relatively clean and relatively unclean water.
FIG. 2 is an enlarged horizontal section taken on lines 2—2 of FIG. 1.
FIG. 3 is a fragmentary perspective view of the FIG. 1 system, partly broken away to show details of construction.
Figure 3:
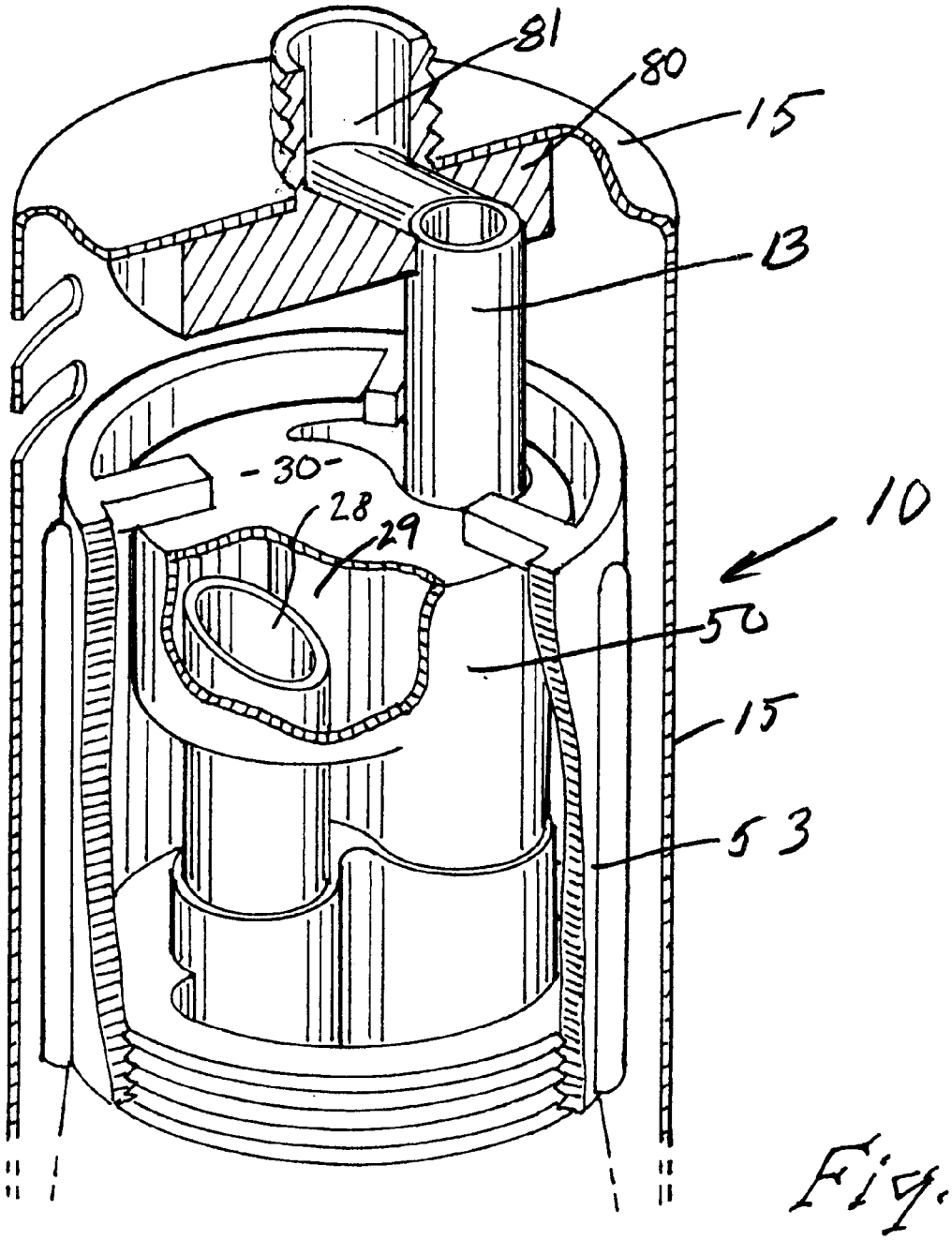

Such compactness is further enhanced by the structure as shown in FIG. 2. Note that at least two of the second, third and fourth conduits have a common wall. For example, conduits 24 and 23 have a primary common wall 21*c*; conduits 24 and 35 have a secondary common wall 21*a*; and conduits 23 and 35 have a tertiary common wall 21*d*. Those common walls have a common junction 48, and they extend arcuately away from that common junction, to fit within the annular enclosing wall 22 and retention structure 49. That structure may be provided by tubular fitting 50 extending above panel 12. That fitting may have threaded connection at 51 and 52 with upper and lower tubular clamping fittings 53 and 54 that clamp to the panel 12, as shown, holding the assembly of conduits in position, as shown.

Note in FIG. 2 that the secondary common wall 21*a* and the tertiary common wall 21*d* both bulge into or toward the fourth conduit, whereby extreme compactness of the wall structure and conduit structure as in FIG. 2 is provided, to fit through the small sink panel opening 11, for handling the liquid stream. The liquid stream in duct 14 can be designated liquid stream A; and the liquid stream in conduit 28 can be designated as liquid stream B.

I claim:

1. In a system for handling closely proximate flows of relatively clean and unclean water, the combination comprising a) a first conduit for passing relatively clean water to a first discharge, b) a second conduit extending protectively about the first conduit, c) a third conduit extending proximate and lengthwise of the second conduit for passing said relatively unclean water, outside the second conduit, d) and an outer housing extending about said first, second and third conduits, e) said third conduit having a free discharge proximate to, but isolated from the interior of said second conduit, f) there being a fourth conduit, proximate to said second and third conduits, and having an entrance to receive contaminated water discharge from the third conduit, g) said second, third and fourth conduits configured such that i) said second and said third conduits have a primary common wall ii) said second and fourth conduits have a secondary common wall iii) said third and fourth conduits have a tertiary common wall, h) said primary, secondary and tertiary common walls having a common junction, i) and wherein said common walls extend arcuately away from said common junction, such that both said secondary common wall and said tertiary common wall bulge toward and into said fourth conduit.

2. The combination of claim 1 including a source of said relatively unclean water in communication with said third conduit.

3. The combination of claim 2 wherein said source comprises an automatic dishwasher having an outlet positioned for passing relatively unclean dish water, to flow in said third conduit.

4. The combination of claim 1 including a panel forming an opening through which said first, second, third and fourth conduits pass.

5. The combination of claim 4 wherein said free discharge and said entrance are located above the level of said opening in the panel, whereby contaminated water drains downwardly in said fourth conduit, through said opening, and clean water rises in the first conduit through said opening.

6. The combination of claim 1 wherein said second conduit forms an air space adjacent said first conduit, to block cross contamination between unclean and clean water.

7. The combination of claim 1 including an annular upright fitting integral with said common walls, and clamp fittings adjustably attached to said upright fitting for clamping at a position with the clamp fittings clamping to a panel defining an opening through which said first, second, third and fourth conduits extend.

8. In a system for handling closely proximate flows of liquid streams A and B, the combination comprising a) a first conduit for passing liquid stream A to a first discharge, b) a second conduit extending protectively about the first conduit, c) a third conduit extending proximate and lengthwise of the second conduit for passing said liquid stream B, outside the second conduit, d) and an outer housing extending about said first, second and third conduits, e) said third conduit having a free discharge proximate to, but isolated from the interior of said second conduit, f) there being a fourth conduit, proximate to said second and third conduits, and having an entrance to receive stream B discharge from the third conduit, g) said second, third and fourth conduits configured such that i) said second and said third conduits have a primary common wall ii) said second and fourth conduits have a secondary common wall iii) said third and fourth conduits have. a tertiary common wall, h) said primary, secondary and tertiary common walls having a common junction, i) and wherein said common walls extend arcuately away from said common junction, such that both said secondary common wall and said tertiary common wall bulge toward and into said fourth conduit.

* * * * *